United States Patent [19]

Calvino

[11] 4,440,996

[45] Apr. 3, 1984

[54] DEAD TANK GAS-INSULATED PUFFER-TYPE CIRCUIT INTERRUPTER HAVING INTERRUPTING UNIT IN INSULATED CASING

[75] Inventor: Ben J. Calvino, Monroeville, Pa.

[73] Assignee: Westinghouse Electric Corp., Pittsburgh, Pa.

[21] Appl. No.: 331,941

[22] Filed: Dec. 17, 1981

[51] Int. Cl.[3] ..... H01N 33/88

[52] U.S. Cl. ..... 200/148 A; 200/148 R; 200/148 D; 200/148 E; 200/148 F

[58] Field of Search ..... 200/148 D, 148 F, 148 E, 200/148 A, 148 R

[56] References Cited

U.S. PATENT DOCUMENTS

| | | | |
|---|---|---|---|
| 2,997,564 | 8/1961 | Baker | 200/148 A |
| 4,223,191 | 9/1980 | Calvino | 200/148 F |
| 4,365,126 | 12/1982 | Oshima et al. | 200/148 F |

FOREIGN PATENT DOCUMENTS

| | | | |
|---|---|---|---|
| 1052504 | 3/1959 | Fed. Rep. of Germany | 200/148 D |
| 2825744 | 5/1979 | Fed. Rep. of Germany | 200/148 E |
| 637566 | 4/1962 | Italy | 200/148 E |
| 670679 | 10/1964 | Italy | 200/148 D |
| 449098 | 4/1968 | Switzerland | 200/148 D |
| 2038099 | 7/1980 | United Kingdom | 200/148 F |

*Primary Examiner*—Robert S. Macon
*Attorney, Agent, or Firm*—M. S. Yatsko

[57] ABSTRACT

A gas-insulated circuit breaker is described which includes a Y-shaped, hollow grounded metal base member formed from a support section and two angularly-extending legs. A hollow insulating casing is secured to each base member leg. A stationary and a movable contact, separable from each other to establish an arc therebetween, are disposed in one of the casings, with an insulating gas disposed within both the base member and the insulating casings. A mechanism is used for directing a blast of insulating gas into the arc established between the separating contact, and includes a piston fixedly disposed in the one casing and a puffer cylinder secured to the movable contact and movable over the piston to compress the gas therebetween. An operating mechanism is associated with the base member support section for moving the movable contact, and a drive rod insulatably connects the movable contact and the operating mechanism. The operating mechanism thus moves the movable contact through the insulating drive rod.

9 Claims, 8 Drawing Figures

FULLY-OPEN POSITION

ARCING POSITION

CLOSED POSITION

COVENTIONNAL DEAD TANK

DEAD TANK GAS-INSULATED PUFFER-TYPE CIRCUIT INTERRUPTER HAVING INTERRUPTING UNIT IN INSULATED CASING

BACKGROUND OF THE INVENTION

This invention relates generally to circuit interrupting apparatus, and more specifically to a high-voltage, gas-insulated puffer-type circuit breaker having the interrupting unit disposed within an insulating casing.

High voltage power circuit breakers today are generally grouped into two classes: live tank and dead tank designs. A dead tank circuit interrupter generally is one in which the interrupting unit, with its separating contacts, is disposed within an electrically grounded metal tank which then is disposed on or at physical ground level. A live tank design, on the other hand, has its interrupting unit, with its separating contacts, disposed in an insulating housing which then is supported upon an insulating column. This difference in configuration is partially the result of the various regulatory codes in effect in both the United States and in foreign countries, which codes typically specify that the base of the insulators should be at a definite distance to earth independent of the voltage class considered, thereby implying that the lowest live part has to be at a distance to ground dependent on the voltage class and basic impulse level prescribed. In the case of the dead tank circuit breaker, the terminals correspond to the highest point of the circuit breaker and the lowest point of live parts. Conversely, in a live tank circuit breaker, these dimensions can vary depending on the interrupter chamber configuration: horizontal, oblique, vertical. These dimensions often define the height of the substation steel structures required, and considerable savings in substation structure costs can often be realized with a dead tank concept.

The dead tank circuit breaker also exhibits numerous advantages over the live tank circuit breaker. For example, the built-in current transformers which can be utilized with the dead tank circuit breaker provide significant economical advantages. Similarly, the dead tank circuit breakers present simplicity of erection and easy insulation coordination to ground, exhibit better size and withstand characteristics due to having a lower center of gravity and lighter live parts, and the interrupter mechanical support insulator and operating rod in the dead tank interrupter can be of small dimensions and not be subjected to ambient pollution.

The live tank circuit interrupter also has numerous advantages. For example, generally the cost of the circuit breaker itself is smaller for the live tank circuit breaker than for the dead tank circuit breaker. Furthermore, the live tank circuit breaker generally uses a smaller quantity of gas than does a dead tank circuit interrupter, for the same voltage classification and withstand levels. Furthermore, an important advantage of the live tank circuit breaker is the electric field distribution between separated contacts when the breaker is in the open position. The electric field stresses between the contacts in the open position for the live tank circuit breaker are significantly less concentrated for the live tank design than is the electric field configuration for the dead tank design.

SUMMARY OF THE INVENTION

In accordance with this invention, there is provided a gas-insulated circuit breaker which includes a Y-shaped, hollow grounded metal base member formed from a support section and two angularly-extending legs. A hollow insulating casing is secured to each base member leg, with the casings having covers secured to the ends thereto to prevent the escape of the insulating gas. A stationary and movable contact, separable from each other to establish an arc therebetween, are disposed in one of the casings, with an insulating gas disposed within both the base member and the insulating casings. Means are disposed within the one casing for directing a blast of insulating gas into the arc established between the separating contacts. These blast directing means include a piston fixedly disposed in the one casing and a puffer cylinder secured to the movable contact and movable over the piston to compress the gas therebetween. An operating mechanism is associated with the base member support section for moving the movable contact, and a drive rod insulatably connects the movable contact and the operating mechanism. The operating mechanism thus moves the movable contact through the insulating drive rod.

BRIEF DESCRIPTION OF THE DRAWINGS

Reference is now made to the description of the preferred embodiments, illustrated in the accompanying drawings, in which.

DESCRIPTION OF THE PREFERRED EMBODIMENTS

Figure 1:
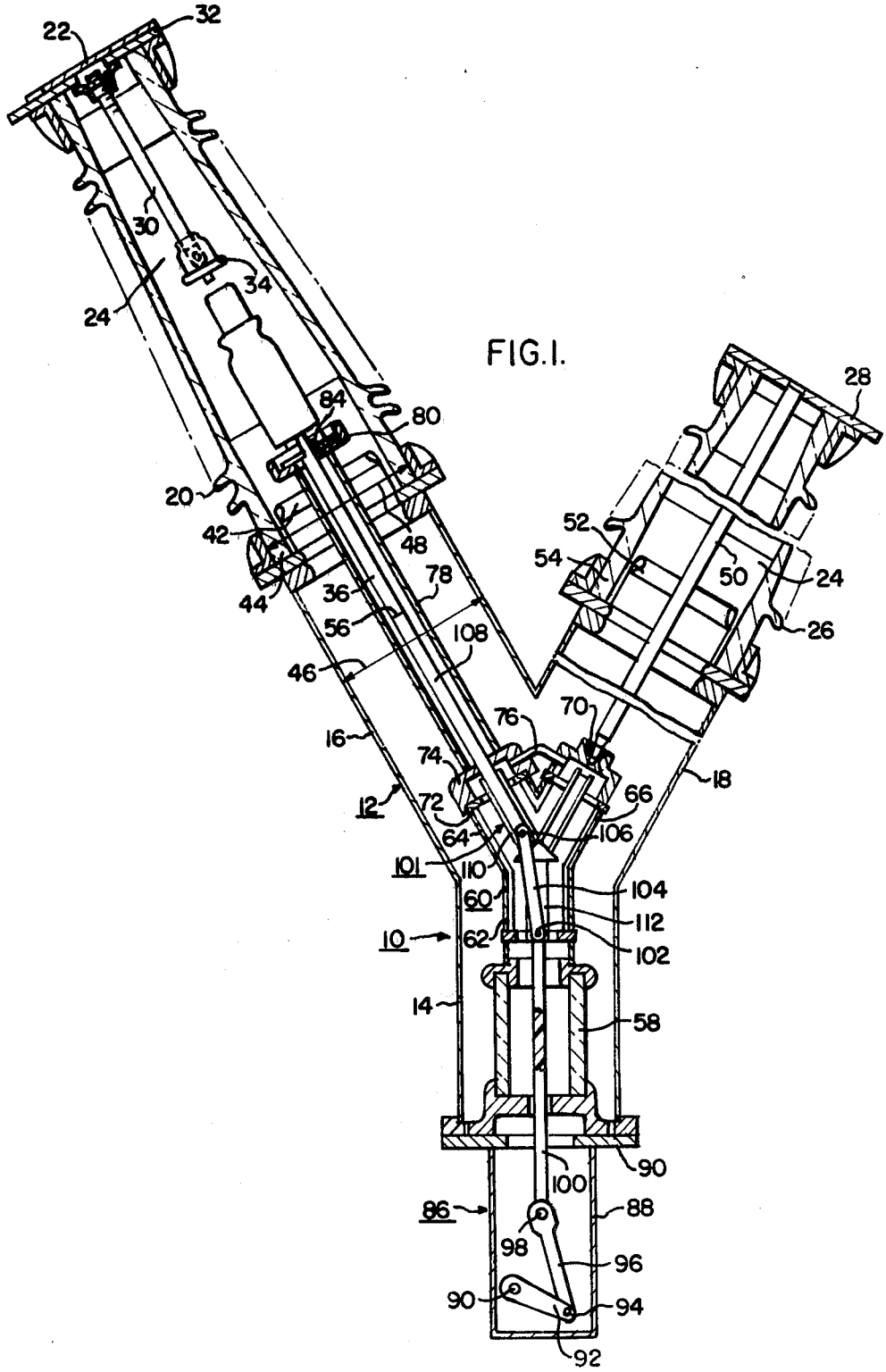
FIG. 1 is a view, partly in section and partly in elevation, of a circuit breaker according to the teachings of this invention with the separable contacts in the open position.

Referring now more particularly to FIG. 1, therein is illustrated the gas-insulated circuit breaker 10 according to the teachings of this invention. The circuit breaker 10 includes a Y-shaped, hollow grounded metal base member 12 which is formed of a base member support section 14 and two angularly extending legs 16, 18 which form an angle of about sixty degrees therebetween. Secured to the base member leg 16 is a hollow insulating casing 20 which has a cover 22 secured thereto at the end distal from the leg 16 for preventing the escape of the insulating gas 24 which fills the interior of the casing 20 and the leg 16. Likewise, a hollow insulating casing 26 is secured to the base member leg 18 and the casing 26 has a cover 28 secured thereto to also prevent escape of the insulating gas 24 from the interior of the casing 26.

Disposed within the casing 20 is a stationary contact 30 which is electrically connected to a first terminal 32 which would be connected, for example, to an incoming power line. The stationary contact 30, as illustrated, has a stationary contact shield 34 secured thereto. This shield 34 is optional, for the purpose of increasing the interrupting capability of the circuit interrupter 10, but the circuit breaker 10 can function without the shield 34 being secured to the stationary contact 30. Also disposed within the insulating casing 20 is the movable contact 36 (see FIG. 3). The movable contact 36 is secured, through the spider 38, to a movable puffer cylinder 40, the function of which will hereinafter be described.

Also disposed within the casing 20 (see FIG. 1) is the bushing shield 42 which functions to control the electric field gradients at the end 44 of the casing 20 where it is connected to the base member leg 16. Also to be noted is that the base member leg 16 has an outside diameter 46 which is the same as the casing outside diameter 48 at the location where the casing 20 is secured to the base member leg 16.

Disposed in the other casing 26 is an electrical conductor 50 which is electrically connected to the end cover 28 which also functions as a line terminal which may be connected, for example, to an outgoing electrical power line. As before, an electrical grading shield 52 is disposed within the casing 26 to control the electrical gradients at the base 54 of the casing 26 where it is secured to the base member leg 18.

Disposed on the insulating support 58 within the base member 12 is a Y-shaped contact support 60 comprised of a contact support base 62 aligned with the base member support section 14, and two angled contact support legs 64, 66 aligned with the base member legs 16, 18, respectively. The contact support leg 66 has at its outermost end a contact structure 70 which mates with the electrical conductor 50 to provide electrical contact and continuity therewith. The contact support leg 64 has secured to the end 72 thereof the transfer support 74. The transfer support 74 is electrically connected to the contact structure 70 by means of the shunt element 76.

The transfer support 74 supports the interrupter support 78 which is aligned with the base member leg 16 and which extends upwardly into the casing 20 and supports therein the contact structure 80. The contact structure 80 physically supports the stationary puffer piston 82 within the casing 20, and further provide electrical continuity, through the contacts 84, between the movable contact 36 and the interrupter support 78. Thus, the electrical path through the interrupter 10 is complete, when the contacts are in the closed position, from the incoming line (not shown) through the terminal 32, the stationary contact 30, the movable contact 36, the contacts 84 and the contact support 80, through the interrupter support 78, the transfer support 74, the shunt 76, the contact structure 70, and the electrical conductor 50 to the terminal 28.

Associated with the base member support section 14 is an operating mechanism 86. This operating mechanism 86, although illustrated as being contained within the housing 88 which is secured to the bottom flange 90 which encloses the support section 14 of the base member 12, may instead be included within the base member support section 14 if such support section 14 is constructed more elongated than that illustrated. The operating mechanism 86 is comprised of a drive shaft 90 which would extend through the housing 88 to externally of the circuit breaker and be connected either to a manual handle (not shown) or to a pneumatic operating mechanism (not shown) of the type illustrated in U.S. Pat. No. 4,110,578. The drive shaft 90 is fixedly connected to the drive lever 92 which in turn is pivotally connected, as at 94, to the link 96. The link 96 is pivotally connected at the pin 98 to an insulating drive rod 100 which extends into the base member support section 14 and into the contact support base section 62. The insulating drive rod 100 is, in turn, pivotally connected as at 102 to a connecting link 104 which itself is pivotally connected at 106 to the operating rod 108. The operating rod 108 is itself fixedly connected to the movable contact 36 as at 56, and the operating rod 108 is reciprocally movable within the operating rod guide 110 which is supported by the contact support 74. The operating mechanism 86 thus is capable of providing the reciprocating movement of the movable contact 36 by means of the drive rod means 101 which comprises the operating rod 108, the link 104, and the drive rod 100.

Figure 4:
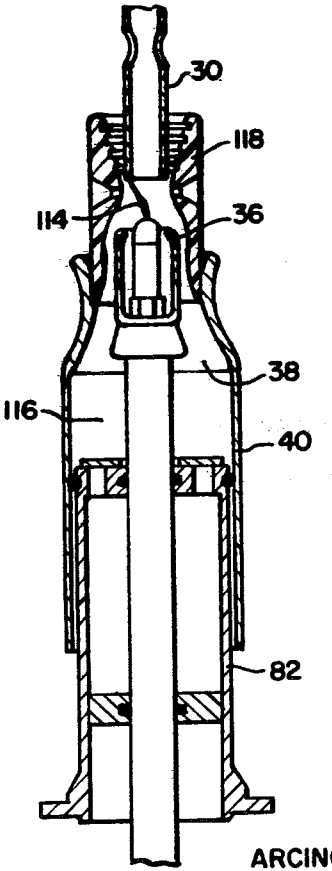
FIG. 4 is an illustration of the interrupting unit breaker of FIG. 3 but with the contacts in the initial arcing position.
Figure 3:
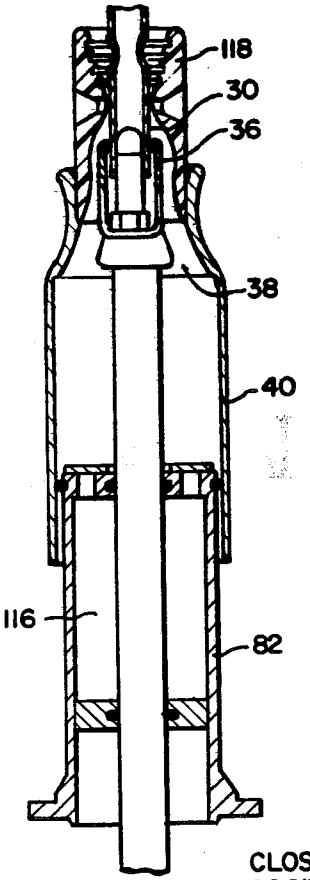
FIG. 3 is a view of the interrupting unit with the contacts in the closed position.

The operation of the circuit breaker 10 can best be understood with reference sequentially to FIGS. 1 and 3–5. In FIG. 3, the movable contact 36 is physically contacting the stationary contact 30, in a position in which the contacts are closed. As the breaker is operated (see FIG. 1), the drive shaft 90 is rotated in the clockwise direction, which causes a corresponding clockwise rotation of the lever 92. This clockwise rotation of the lever 92 causes a downward movement of the link 96, which causes a corresponding downward movement of the drive rod 100 as it moves within its drive rod guide 112. The downward movement of the drive rod 100 causes a downward movement of the link 104 which causes movement of the operating rod 108 within the guide 110. Movement of the operating rod 108 causes a downward movement of the movable contact 36, causing it to separate from the stationary contact 30 and results in the establishment of an arc 114 between the stationary contact 30 and the movable contact 36 (FIG. 4). Downward movement of the movable contact 36 also caused a downward movement of the puffer cylinder 40 which is secured to the movable contact 36, and the movable puffer cylinder 40 has moved over the stationary piston 82 to compress the gas 24 in the area 116 between the cylinder 40 and the piston 82. The gas which was compressed in the area 116 increases in pressure and as the contacts 30, 36 continue separating, this gas blasts into the arc 114 between the separating contacts 30, 36, directed by the insulating nozzle 118 which is secured to the puffer cylinder 40. This blast of insulating gas functions to extinguish the arc 114 thereby providing interruption of the current flow in the circuit.

Figure 5:
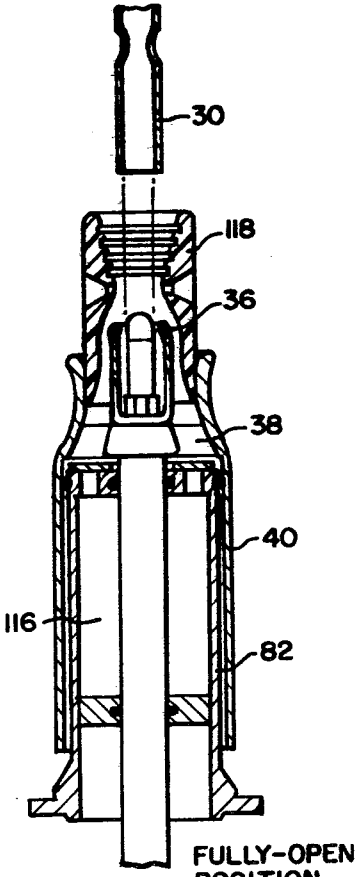
FIG. 5 is a view similar to that of FIG. 3 with the contacts in the fully-open position.

As shown in FIG. 5, continued operation of the operating mechanism 86 has caused complete separation of the movable contact 36 from the stationary contact 30, and electric current can no longer flow between the terminals 32, 28.

As can be seen, the open circuit position of the stationary and movable contacts 30, 36, respectively, occurs within the insulating casing 20. By so locating the contacts 30, 36, a more desirable electric field distribution has been achieved.

Figure 6:
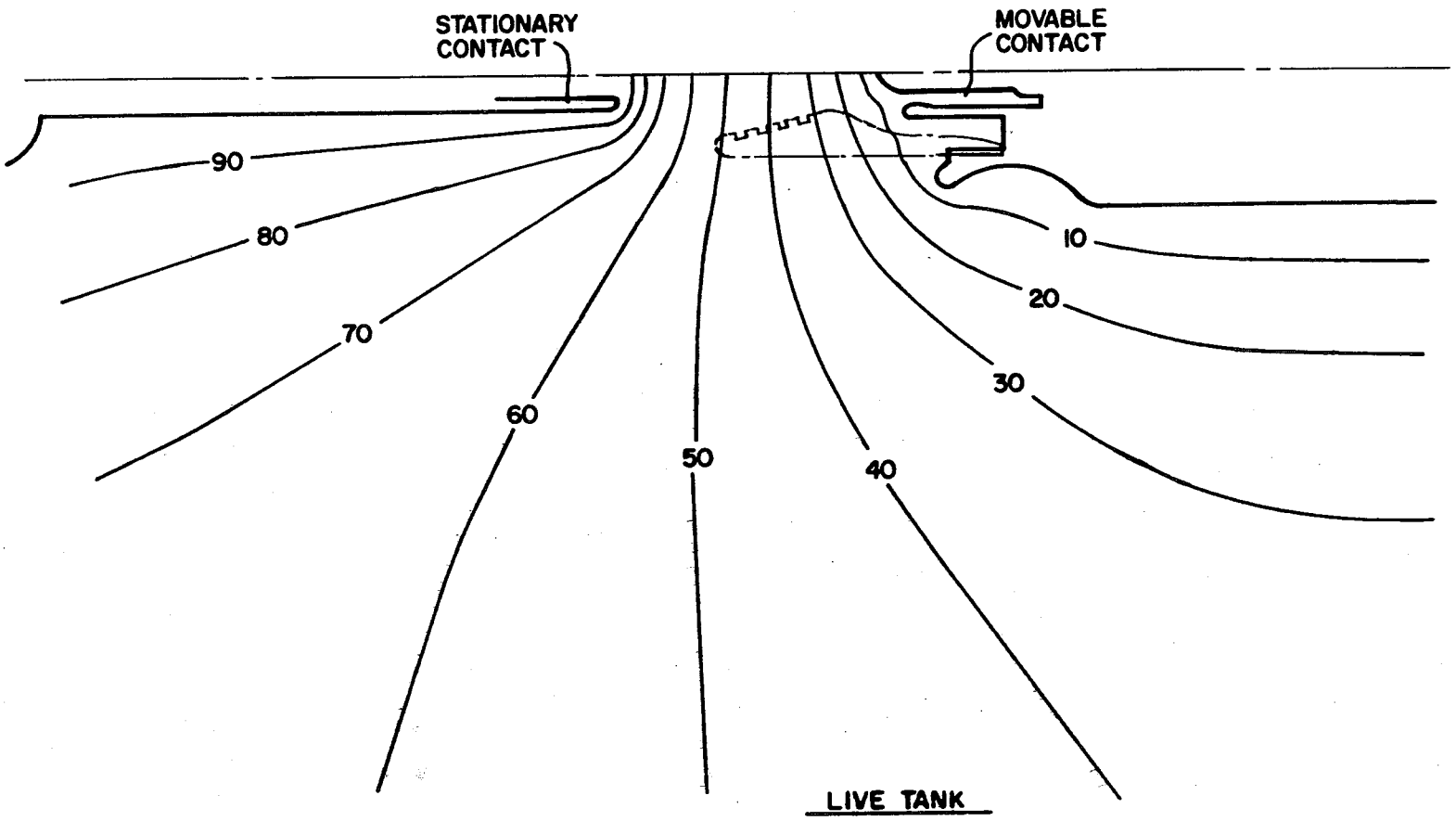
FIG. 6 is a plot of the electric field distribution between open contacts of a typical live tank circuit breaker.
Figure 7:
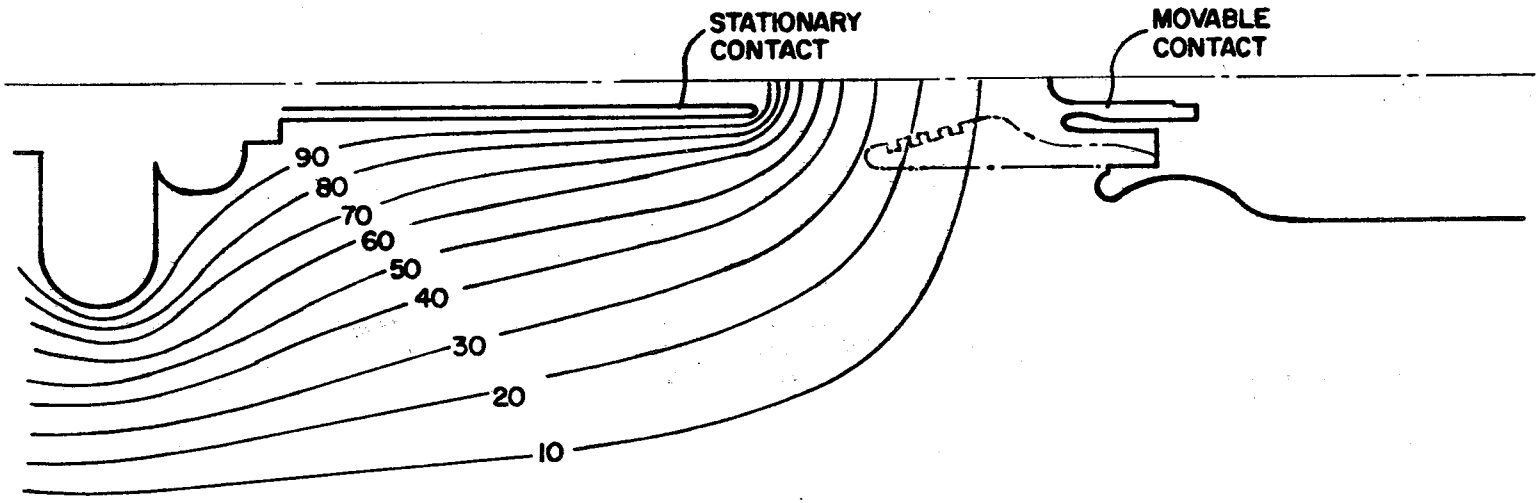
FIG. 7 is a plot of the electric field distribution between open contacts of a conventional dead tank circuit breaker.
Figure 8:
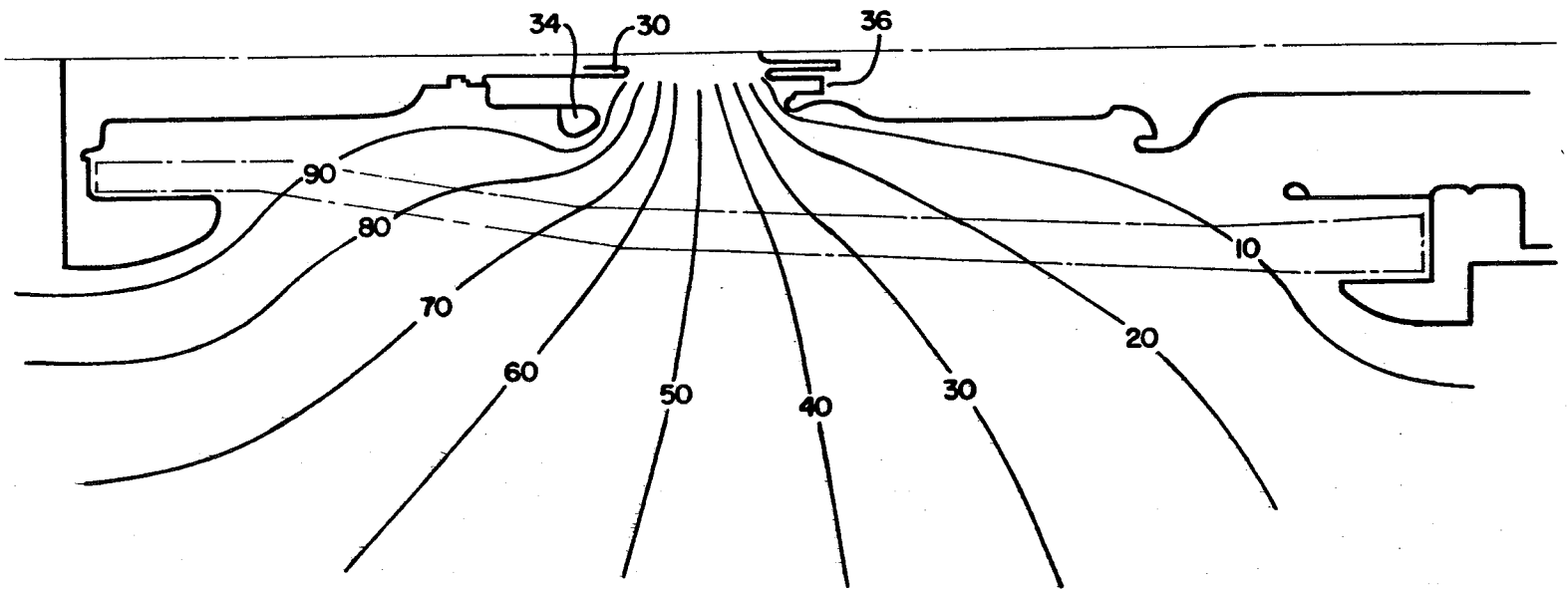
FIG. 8 is a plot of the electric field distribution between the open contacts of the circuit breaker of the present invention.

Referring now to FIGS. 6–8, therein are illustrated plots of the electric field distribution which occurs between separated contacts in three types of circuit breakers. FIG. 6 illustrates the field distribution which occurs in a typical live tank circuit breaker. As can be seen in this Figure, the electric field is distributed fairly uniformly. In FIG. 7, the plot illustrates the electric field distribution between open contacts of a conventional dead tank circuit breaker, and shows that the electric field is fairly concentrated. Indeed, the higher voltage gradient between the separated contacts is evident, and can cause stress problems in the design of the contacts. In FIG. 8 is illustrated the electric field distribution between the separated contacts 30, 36 of the instant invention. As can be seen, the gradients between the contacts 30, 36 resemble those of the less electrically-stressed live tank circuit breaker, with its lower electrical gradients, even through the circuit breaker 10 of this invention is of the dead tank variety. Thus, because the separated contacts 30, 36 are disposed within the insulating casing 20, a more desirable electric field distribution between the contacts 30, 36 when in the open position has occurred.

Figure 2:
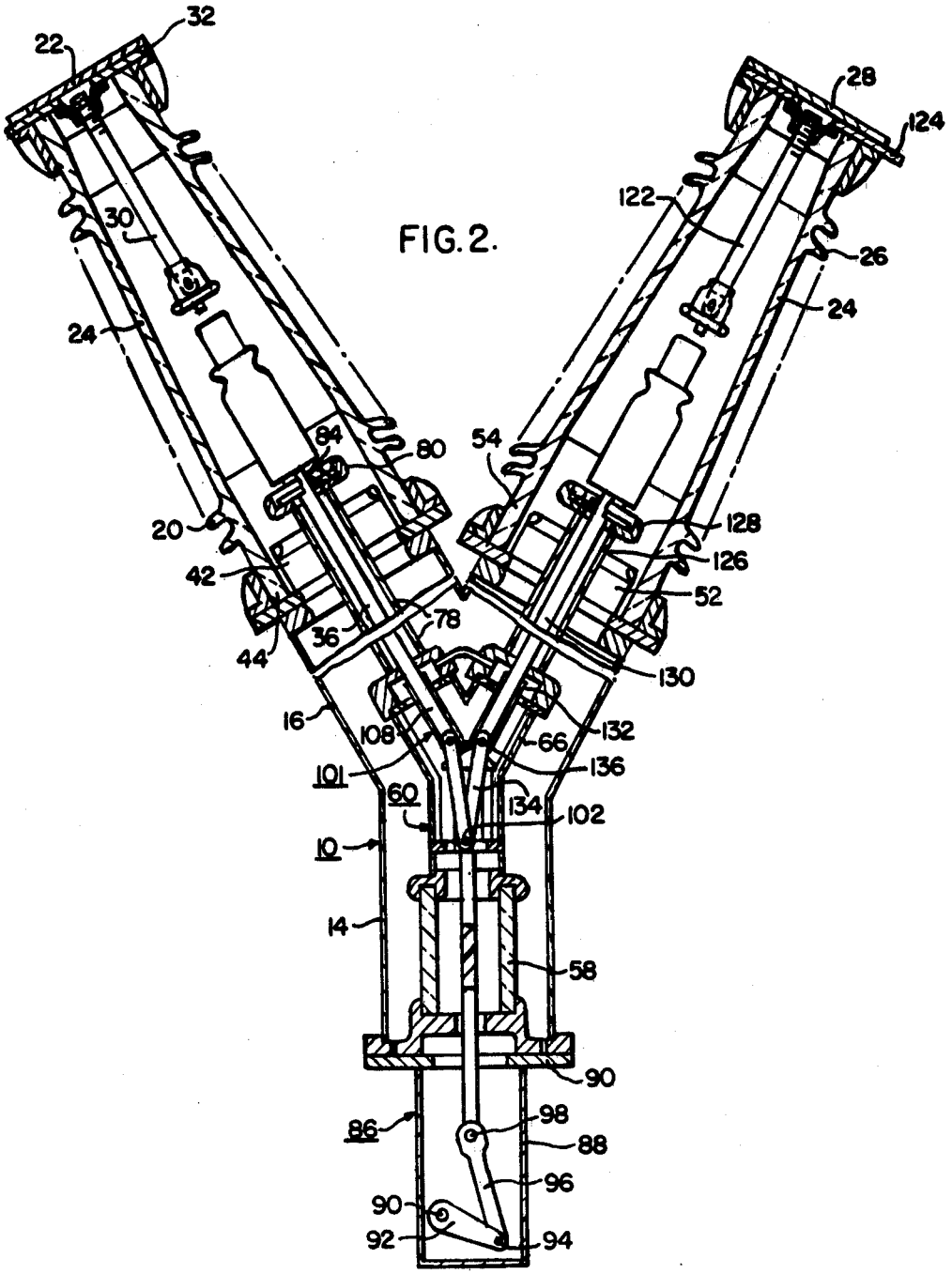
FIG. 2 is a modification of the circuit breaker of FIG. 1 having two pairs of contacts serially connected, with both contacts being in the open position.

Referring now more particularly to FIG. 2, therein is shown a modification of the circuit breaker of FIG. 1 which is applicable for interrupting higher voltages. In this modification, the left side of the circuit breaker (as shown in the drawings) is identical to that as previously described. The righthand side of the circuit breaker, however, has been changed in that the electrical conductor 50 is no longer disposed in the casing 26 or the base member leg 18. Instead, a stationary contact 122 is fixedly secured to the end cover 28 and terminal 124. The contact support structure 66 includes an interrupter support 126 which supports a contact structure 128 which, in turn, fixedly supports the second puffer piston 82 in the casing 26. A second movable contact 36 cooperates with the stationary contact 122 in the casing 26 to provide a second interrupting unit. The movable contact 36 is fixedly secured through a spider 38 to the puffer cylinder 40, which puffer cylinder 40 is slidable over the fixed puffer piston 82 to compress the gas in the area therebetween. A second operating rod 130 is connected to the movable contact 36, which operating rod 130 is reciprocally movable within the guide 132. A second connecting link 134 is pivotally secured as at 136 to the second operating rod 130, and the other end of the connecting link 134 is pivotally connected to the drive rod 100 at the same location as is the first connecting rod 104, that is at the pivot point 102. Thus, operation of the operating mechanism 86 moves both movable contacts 36 at the same time. The interruption, the movement, and the interaction of the stationary and movable contacts in the casing 26 occurs as was previously described with respect to the interrupting unit disposed in the casing 20 as is shown in FIGS. 3–5. With the two movable contacts 36 in the two casings 20, 26, the movable contact 36 in the casing 26 is electrically connected to the contact support assembly 70, which in turn is electrically connected to the transfer support 74 by means of the shunt 76. By being so connected, the movable contacts are electrically serially connected, and interruption of the current between terminals 28 and 32 occurs in two breaks instead of the one break as in the previous embodiment.

Therefore, it can be seen that applicant's invention provides an improved and more useful circuit breaker which provides advantages from both live tank and dead tank designs of circuit breakers.

I claim as my invention:

1. A gas-insulated circuit breaker comprising:

a Y-shaped, hollow grounded metal base member having a support section and two angularly-extending legs;

a hollow insulating casing secured to each base member leg and having a cover secured to the end thereof distal from said base member leg;

a stationary contact disposed in one of said casings;

a movable contact disposed in said one casing and separable from said stationary contact to establish an arc therebetween;

an insulating gas disposed within said base member and said casings;

means disposed within said one casing for directing a blast of insulating gas into the arc established between said separating contacts comprising a piston fixedly disposed in said one casing and a puffer cylinder secured to said movable contact and movable over said piston to compress the gas therebetween;

an operating mechanism associated with said base member support section for moving said movable contact; and drive rod means insulatably connecting said movable contact and said operating mechanism, said operating mechanism moving said movable contact through said drive rod means.

2. The circuit breaker according to claim 1 including an electrical conductor disposed in the other of said casings and extending through said base member leg associated therewith, said conductor being electrically serially connected to said movable contact.

3. The circuit breaker according to claim 2 including a Y-shaped contact support insulatably supported within said base member and including two angled contact support legs aligned with said base member legs and said casings, one of said contact support legs supporting said piston in said one casing and being electrically connected to said movable contact, the other of said contact support legs being electrically serially connected to said movable contact.

4. A gas-insulated circuit breaker comprising:

a Y-shaped, hollow grounded metal base member having a support section and two angularly-extending legs;

a first hollow insulating casing secured to one of said base member legs and having a cover secured to the end thereof distal from said one base member leg;

a second hollow insulating casing secured to the other of said base member legs and having a cover secured to the end thereof distal from said other base member leg;

a first stationary contact disposed in said first casing;

a first movable contact disposed in said first casing and separable from said first stationary contact to establish an arc therebetween;

a second stationary contact disposed in said second casing;

a second movable contact disposed in said second casing and separable from said second stationary contact to establish an arc therebetween;

means for electrically serially connecting said first and second movable contacts;

a common insulating gas disposed within said base member and said casings;

first means disposed within said first casing for directing a blast of insulating gas into the arc established between said separating first contacts comprising a first piston fixedly disposed in said first casing and a first puffer cylinder secured to said first movable contact and movable over said first piston to compress the gas therebetween;

second means disposed within said second casing for directing a blast of insulating gas into the arc established between said separating second contacts comprising a second piston fixedly disposed in said second casing and a second puffer cylinder secured to said second movable contact and movable over said second piston to compress the gas therebetween;

a common operating mechanism associated with said base member support section for moving said movable contacts; and drive rod means insulatably connecting said first and second movable contacts and said operating mechanism, said operating mechanism moving said first and second movable contacts through said drive rod means.

5. The circuit breaker according to claim 4 including a Y-shaped contact support insulatably supported within said base member and including two angled contact support legs aligned with said base member legs and said first and second casings, one of said contact support legs supporting said first piston in said first casing and the other of said contact support legs supporting said second piston in said second casing.

6. The circuit breaker according to claim 5 wherein said serial connecting means comprises said one support leg being electrically connected to said first movable contact, said other support leg being electrically connected to said second movable contact, and said contact support legs being electrically connected to each other.

7. A circuit breaker according to claim 1 or 4, wherein each base member leg has an outside diameter, and each casing has an outside diameter at the location where the casing is secured to the respective base member leg the same as said base member leg outside diameter.

8. A circuit breaker according to claim 1 or 4, wherein the angle formed between said two angularly-extending base member legs is substantially sixty degrees.

9. A circuit breaker according to claim 1 or 4, wherein said circuit breaker is vertically disposed with said base member legs being vertically higher than said base member support section.

* * * * *